United States Patent [19]

Wethington

[11] B 4,001,071

[45] Jan. 4, 1977

[54] CARPET MACHINE

[75] Inventor: Charles A. Wethington, Spartanburg, S.C.

[73] Assignee: Deering Milliken Research Corporation, Spartanburg, S.C.

[22] Filed: June 8, 1974

[21] Appl. No.: 475,385

[44] Published under the second Trial Voluntary Protest Program on March 9, 1976 as document No. B 475,385.

[52] U.S. Cl. ..... 156/435; 156/72

[51] Int. Cl.[2] ..... D04H 11/08

[58] Field of Search ..... 156/72, 435, 578, 356, 156/547, 176, 178, 204, 179, 189, 173; 118/8, 256, 260

[56] References Cited

UNITED STATES PATENTS

| | | | |
|---|---|---|---|
| 1,784,552 | 12/1930 | Smith et al. | 156/435 |
| 2,116,048 | 5/1938 | Smith | 156/435 |
| 2,831,525 | 4/1958 | Cole | 156/471 |
| 3,542,625 | 11/1970 | Vernier | 156/435 |

FOREIGN PATENTS OR APPLICATIONS

| | | | |
|---|---|---|---|
| 1,407,101 | 6/1965 | France | 156/72 M |
| 1,560,873 | 10/1969 | Germany | 156/435 |

*Primary Examiner*—William A. Powell
*Assistant Examiner*—Michael W. Ball
*Attorney, Agent, or Firm*—H. William Petry; Earle R. Marden

[57] ABSTRACT

Method and apparatus to produce a bonded loop pile carpet. The carpet machine is of the rotary type which uses cooperating notched blade members to form the yarn loops for bonding to a backing sheet. One set of the blade members is reciprocably mounted in the rotor of the machine.

3 Claims, 6 Drawing Figures

CARPET MACHINE

It is an object of this invention to provide a method and apparatus to efficiently, inexpensively and continuously produce a bonded loop pile carpet.

Other objects and advantages of the invention will become readily apparent as the specification proceeds to describe the invention with reference to the accompanying drawings, in which.

Figure 1:
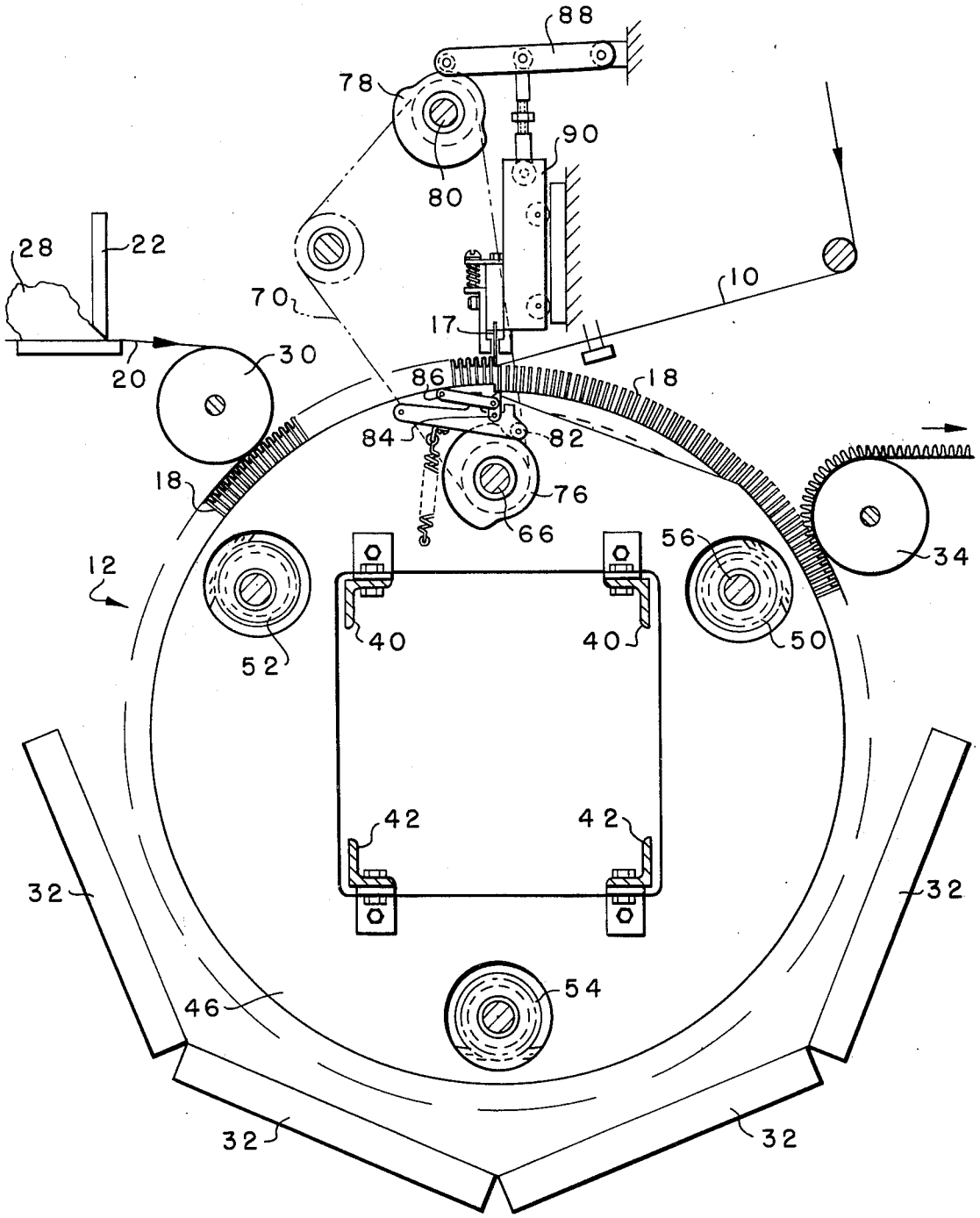
FIG. 1 is a sectional elevation view taken on line 1—1 of FIG. 2.
Figure 2:
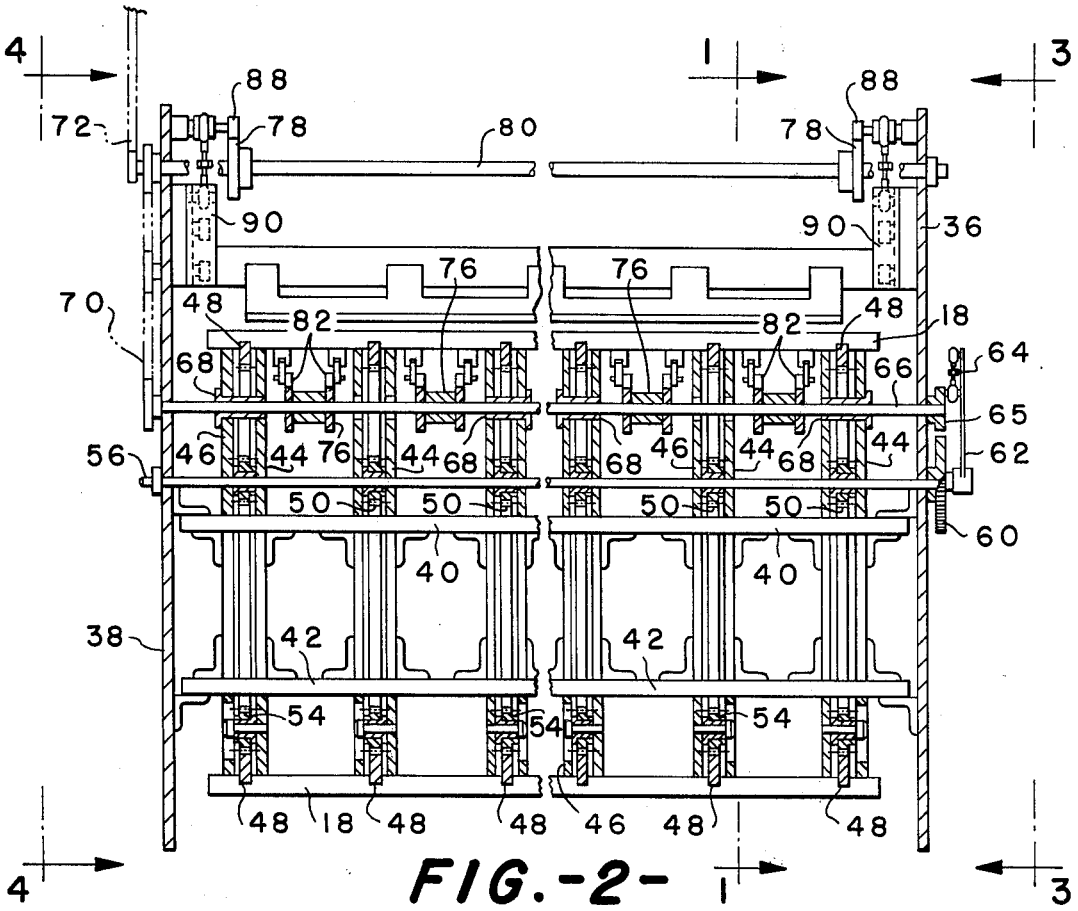
FIG. 2 is a cross-sectional elevation view of the carpet machine rotor.

Looking at FIGS. 1, 3 and 4, the overall concept will be explained. A plurality of yarn ends 10 is supplied from a warp beam or creel (not shown) in the rotor 12 over a pair of rolls 14 and 16. At the rotor, upper blade 17 cooperates with the lower blades 18 to insert the yarn in loops between the lower blades 18. The rotor is rotated counterclockwise and the loops are inserted into a suitable adhesive, such as polyvinyl chloride, placed on a backing sheet 20 by the doctor blade 22. The backing sheet is supplied from a roll 30 to a position against the top of loops. The backing sheet with the loops thereattached continues to rotate counterclockwise past the infrared electric heaters 32 to set the bond between the loops and the backing sheet. The bonded carpet is then doffed over roll 34 and delivered to the take-up roll (not shown).

The rotor 12 is supported between side plates 36 and 38 by cross-supports 40 and 42 to which are attached a plurality of support plates 44 and 46. Rotably supported between the plates 44 and 46 are blade support rings 48 which are held in position by drive gear 50 and idler gears 52 and 54 which are mounted on one of the plates 44 and 46 and engage the toothed inner surface of the rings 48. Each of the blade support rings 48 has a plurality of notches cut in the outer surface thereof to slidably support the lower blades 18. The lower blades are held in the notches by suitable means such as springs or support rings at the ends of the blades (not shown).

The driven gears 50 are rigidly secured to a rotably mounted shaft 56 which is intermittently rotated by the action of the pawl 58 against the ratchet 60 mounted on one end of shaft 56. The pawl 58 is pivotally mounted and actuated by the crank arm 62 which is rotated by the lever 64 connected to the crank 65. Crank 65 is mounted on shaft 66 supported by bearings 68 in the plates 44 and 46 and is driven by chain 70 which is driven from a drive source (not shown) by chain 72. A second pawl 74 is pivotally mounted adjacent the ratchet 60 to prevent back lash of the ratchet.

Also mounted on the shaft 66 between adjacent pairs of plates 44, 46 are cams 76 to periodically actuate the blades 18. Another set of cams 78 is mounted on shaft 80 which is also driven by chain 70 in timed relation so that the cams 76 and 78 rotate in a one-to-one ratio.

Each of the cams 76 have a pair of spring loaded followers 82 operably associated therewith to slide upwardly one of the lower blades 18 at a predetermined time. The follower causes the pivotally mounted arm 84 to move upwardly to engage the blade 18. Another lever 86 is pivotally connected to cause the arm 84 to move in a substantially perpendicular direction to raise the blade 18 straight up. Cams 78 are operably associated with a follower arm 88 pivotally connected to the frame of the machine to raise and lower the upper blade holder 90.

In the preferred embodiment the rotor 12 is stopped when the blades 17 and 18 are forming the loops and then the rotor is indexed to the next loop forming position but such motion is not mandatory. It is contemplated that the motion of the rotor could be continuous and the blade holder 90 could move therewith in a manner as shown in U.S. Pat. No. 3,385,747 wherein the motion of the top blade is synchronized with the motion of a rotor by having the angular velocity of the blade holder equal to the angular velocity of the rotor during a portion of the loop forming period.

It should be noted that only half the yarn loop is being formed at any one time, thereby reducing the frictional forces on the yarn between the blade 18 and the yarn. This results, necessarily, in a reduction in the amount of force necessary by the blades 17 and 18 to form the yarn loops.

Figure 3:
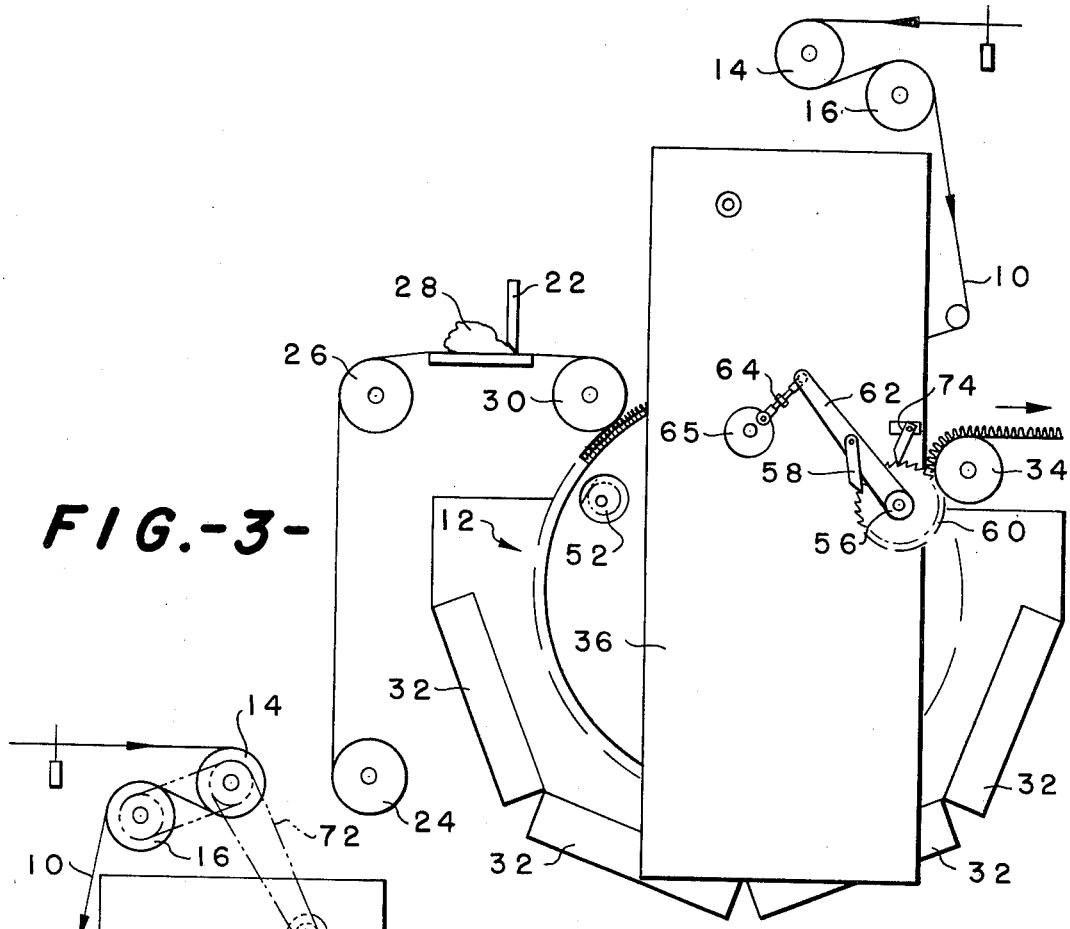
FIG. 3 is an elevation view taken on line 3—3 of FIG. 2.
Figure 4:
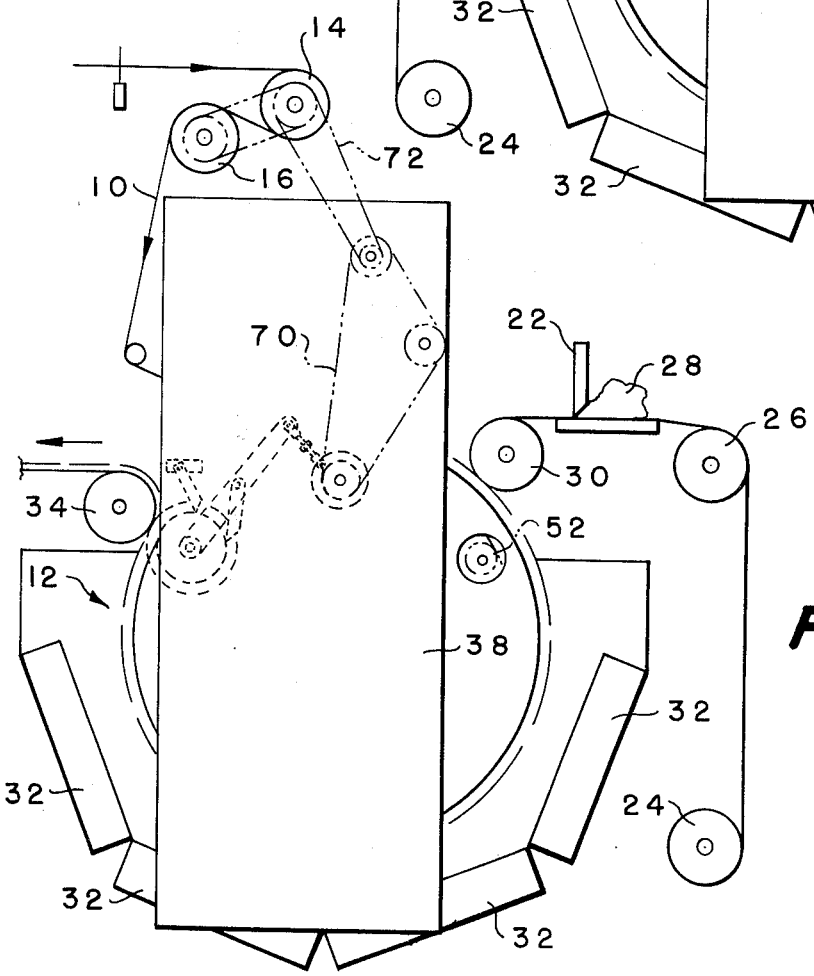
FIG. 4 is an elevation view taken on line 4—4 of FIG. 2.
Figure 5:
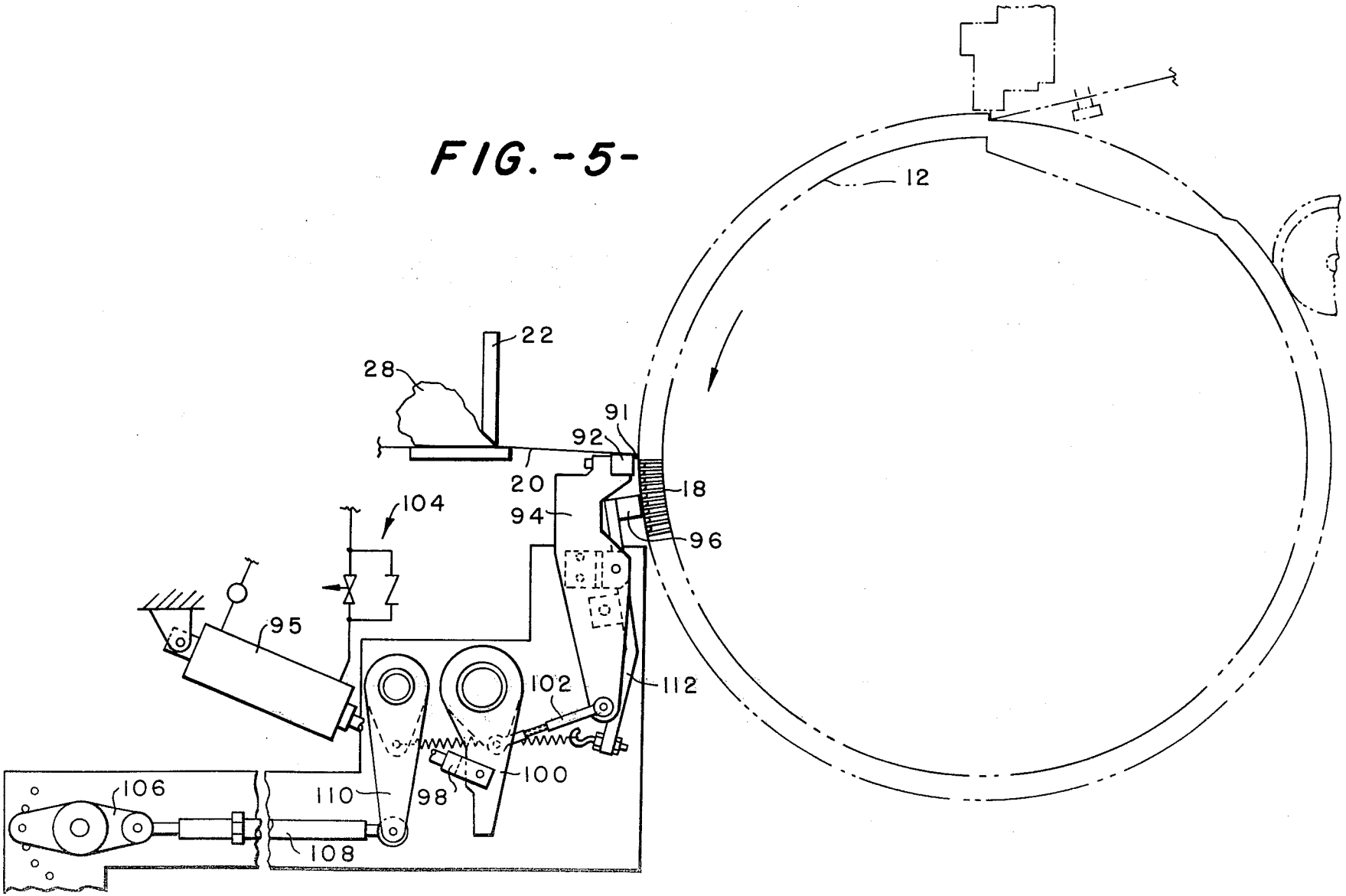
FIG. 5 is a modified version of the mechanism to supply backing material to the formed yarn loops.
Figure 6:
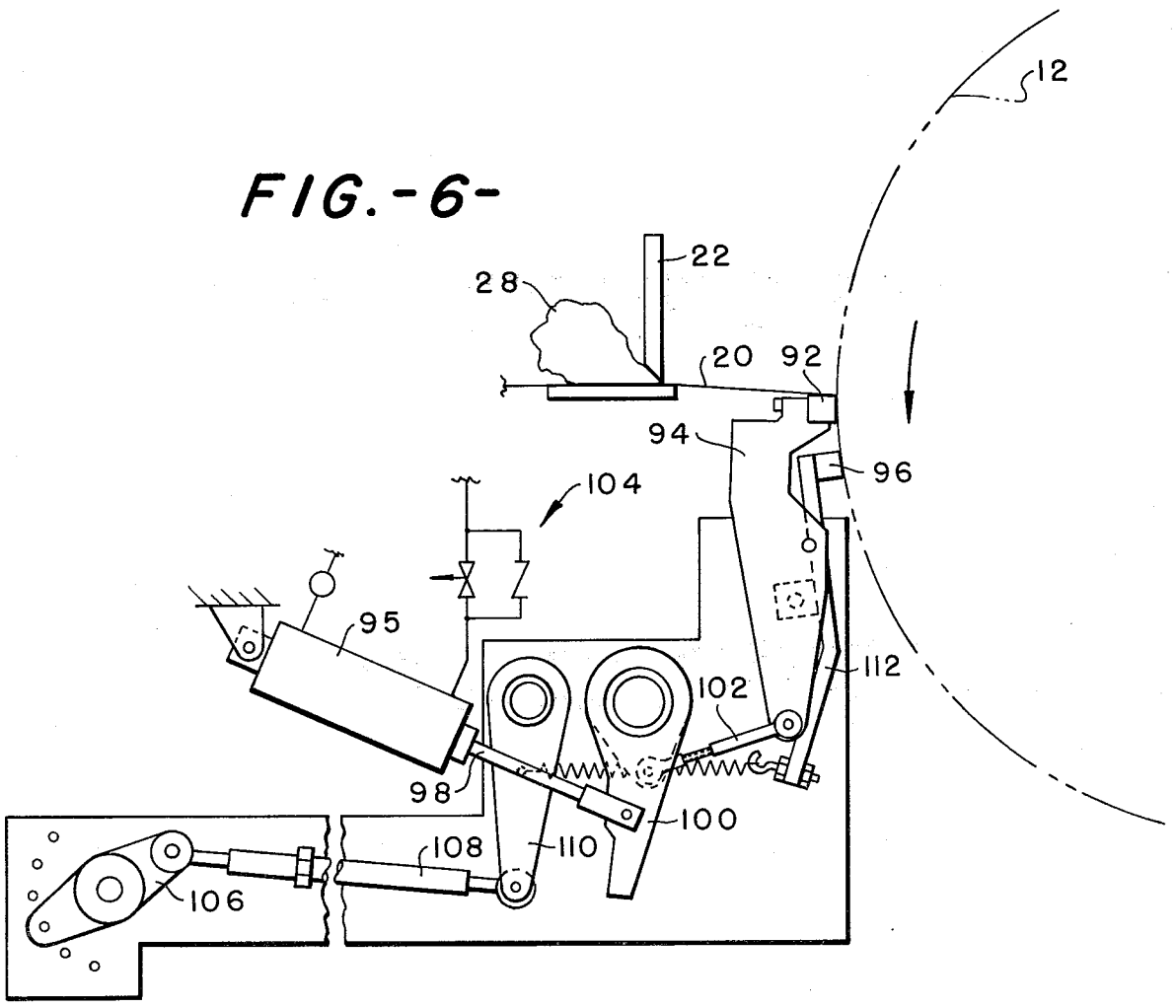
FIG. 6 is similar to FIG. 5 except the mechanism is shown in position when the carpet machine is stopped.

FIGS. 1–4 show schematically a roll 30 is spaced from the rotor 12 by a gap 91 and applies the adhesive coated backing material 20 against the loops previously formed. In practice it is preferred to use the arrangement shown in detail in FIGS. 5 and 6 with FIG. 5 showing the machine in running position and FIG. 6 showing the machine stopped. In FIGS. 1, 3 and 4 the roll 30 tended to allow the adhesive 28 to set up and harden between the roll 30 and the loops on the blades 18 preventing adhesion on start-up. In FIGS. 1, 3 and 4 a gap is required between the adhesive layer and the yarn loop to prevent puddling of the adhesive at the point of juncture of the adhesive and the rotor. This gap causes poor implantation of those yarn loops between the juncture at the point of tangency of the rotor and the backing material when the machine is restarted.

When the machine 12 is stopped the adhesive on the backing material 20 tends to set up due to the heat from the heaters 32 and a good bond is not made between the loops and the backing material 20 at the zone of contact. To prevent this condition the support 94 is pivotally mounted and the double acting piston 95 is actuated (FIG. 6) to pivot the bar member 92 against the backing material 20 when the machine stops, to move the backing material and the adhesive toward the yarn loops on the rotor to implant the loops in the adhesive to ensure a good bond between the yarn and the backing material in that zone when the machine starts. This is caused by the piston 95 pulling the link 98 to pivot the support member 100 which through adjustable linkage 102 pivots the support 94 toward the rotor as shown in FIG. 6. A time delay circuit 104 is incorporated on the piston 95 to allow the rotor to rotate a predetermined distance prior to retraction of support 94 with bar 92 attached thereto.

A multiple positionable rotatable lever member 106 has a lever arm 108 attached thereto to pivot member 110 when desired to provide minor adjustments of the support arm 112 and the bar support 94 and the bar 96. The particular design of this member per se is not a part of the invention since it can assume many obvious shapes and designs.

Although I have described specifically the preferred embodiments of my invention I contemplate that changes may be made without departing from the scope or spirit of my invention and I desire to be limited only by the claims.

That which is claimed is:

1. Apparatus to produce a bonded pile fabric comprising: a rotor, means to rotate said rotor, a set of blade members slidably mounted in said rotor, a second blade member slidably mounted with respect to said rotor and operably associated with said blade members in said rotor, means to supply yarn between said set of blade members and said second blade member, means to slide said second blade member downwardly at a predetermined time to bend the yarn over one blade of said set of blades, means to slide upwardly the blade of said set of blades next adjacent to the blade over which the yarn is bent to form a loop in said yarn, an elongated backing material guiding means spaced from and supplying an adhesive backed backing material into contact with said formed loop, and means operably associated with said elongated guiding means to move and hold said elongate guiding means and the backing material against the previously formed loops when the machine has stopped.

2. The apparatus of claim 1 wherein said means operably associated with said elongated guiding means includes a time delay circuit to allow the rotor to restart prior to retraction of the guiding means from against the previously formed loops.

3. The apparatus of claim 2 wherein said guiding means is a bar.

* * * * *